US011774901B1

(12) United States Patent
Shiokawa et al.

(10) Patent No.: US 11,774,901 B1
(45) Date of Patent: Oct. 3, 2023

(54) DRIVING DEVICE, APPARATUS INCLUDING OPENABLE/CLOSEABLE MEMBER, AND IMAGE FORMING APPARATUS

(71) Applicant: FUJIFILM Business Innovation Corp., Tokyo (JP)

(72) Inventors: Yuya Shiokawa, Kanagawa (JP); Kohei Tachibana, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/966,179

(22) Filed: Oct. 14, 2022

(30) Foreign Application Priority Data

May 27, 2022 (JP) ..... 2022-086992

(51) Int. Cl.
*G03G 21/16* (2006.01)
*G10K 11/16* (2006.01)

(52) U.S. Cl.
CPC ..... *G03G 21/1633* (2013.01); *G03G 21/1647* (2013.01); *G10K 11/16* (2013.01); *G03G 2221/169* (2013.01); *G03G 2221/1657* (2013.01); *G03G 2221/1687* (2013.01)

(58) Field of Classification Search
CPC ..... G03G 15/65; G03G 15/6573; G03G 21/1633; G03G 21/1647; G03G 2221/1657; G03G 2221/1687; G03G 2221/169; G10K 11/16; G10K 11/36; F16F 3/0873; F16F 15/02
See application file for complete search history.

(56) References Cited

U.S. PATENT DOCUMENTS

2019/0344831 A1* 11/2019 Asai ..... F16F 3/0873
2023/0057365 A1* 2/2023 Shiokawa ..... G03G 21/1633

FOREIGN PATENT DOCUMENTS

CN 102467051 A * 5/2012 ..... G03G 21/0029
JP H11-352740 A 12/1999
JP 2002-057475 A 2/2002

OTHER PUBLICATIONS

Machine Translation of CN 102467051 A (publication date of May 23, 2012).*

* cited by examiner

*Primary Examiner* — Sophia S Chen
(74) *Attorney, Agent, or Firm* — Oliff PLC

(57) ABSTRACT

A driving device includes a driving source, a fixing portion to which the driving source is fixed, a first transmission portion attached to the fixing portion to transmit a driving force from the driving source, a second transmission portion engaged with the first transmission portion while having an intermeshing width in a first direction to receive the driving force from the first transmission portion, a mount portion located in the first direction from the fixing portion and to which the second transmission portion is attached, a fastening portion including a mounted portion disposed on a side of the fixing portion opposite to a side facing the mount portion, the fastening portion fastening the fixing portion and the mount portion to each other, a first cushioning member disposed between the mounted portion and the fixing portion, and a second cushioning member disposed between the fixing portion and the mount portion, and having a greater spring constant than the first cushioning member.

20 Claims, 8 Drawing Sheets

COMPARATIVE EXAMPLE

DRIVING DEVICE, APPARATUS INCLUDING OPENABLE/CLOSEABLE MEMBER, AND IMAGE FORMING APPARATUS

CROSS-REFERENCE TO RELATED APPLICATIONS

This application is based on and claims priority under 35 USC 119 from Japanese Patent Application No. 2022-086992 filed May 27, 2022.

BACKGROUND

(i) Technical Field

The present disclosure relates to a driving device, an apparatus including an openable/closeable member, and an image forming apparatus.

(ii) Related Art

Japanese Unexamined Patent Application Publication No. 2002-057475 describes an electric-substrate fixing method including clamping of an electric substrate disposed inside an apparatus with an elastic member to hold the electric substrate, and fixing the elastic member holding the electric substrate to a housing of an apparatus body.

Japanese Unexamined Patent Application Publication No. 11-352740 describes an image forming apparatus that includes a photoconductor rotatably supported by a first support member and an operation member used for image formation. The image forming apparatus drives the photoconductor and the operation member with a driving source or a driving force transmission member disposed at the first support member or a second support member disposed at the first support member. The image forming apparatus includes a vibration damper including a spring having a first end fixed to a base, a viscoelastic member that comes into contact with a second end of the spring due to at least resonance frequency, and a casing surrounding the base, the spring, and the viscoelastic member. The vibration damper is mounted by attaching the base surface to the first support member or the second support member.

SUMMARY

Aspects of non-limiting embodiments of the present disclosure relate to a driving device that includes a driving source, a fixing portion to which the driving source is fixed, a first transmission portion attached to the fixing portion to transmit a driving force from the driving source, a second transmission portion engaged with the first transmission portion while having an intermeshing width in a first direction to receive the driving force from the first transmission portion, a mount portion located in the first direction from the fixing portion and to which the first transmission portion is attached, and a fastening portion including a mounted portion (specifically, for example, a head) disposed on a side of the fixing portion opposite to a side facing the mount portion, the fastening portion fastening the fixing portion and the mount portion to each other.

In the driving device, when the same cushioning members are disposed between the mounted portion and the fixing portion and between the fixing portion and the mount portion, and the cushioning member disposed between the fixing portion and the mount portion is deformed by a large deformation amount, the relative positions of the fixing portion and the mount portions in a first direction are changed, and the intermeshing width of the first transmission portion and the second transmission portion may be reduced.

The present disclosure aims to maintain an intermeshing width between a first transmission portion and a second transmission portion when the same cushioning members are disposed between a mounted portion and a fixing portion and between the fixing portion and a mount portion.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a driving device including a driving source, a fixing portion to which the driving source is fixed, a first transmission portion attached to the fixing portion to transmit a driving force from the driving source, a second transmission portion engaged with the first transmission portion while having an intermeshing width in a first direction to receive the driving force from the first transmission portion, a mount portion located in the first direction from the fixing portion and to which the second transmission portion is attached, a fastening portion including a mounted portion disposed on a side of the fixing portion opposite to a side facing the mount portion, the fastening portion fastening the fixing portion and the mount portion to each other, a first cushioning member disposed between the mounted portion and the fixing portion, and a second cushioning member disposed between the fixing portion and the mount portion, and having a greater spring constant than the first cushioning member.

BRIEF DESCRIPTION OF THE DRAWINGS

Exemplary embodiments of the present disclosure will be described in detail based on the following figures, wherein.

DETAILED DESCRIPTION

An exemplary embodiment according to the present disclosure will be described below with reference to the drawings.

Image Forming Apparatus 10

Figure 1:
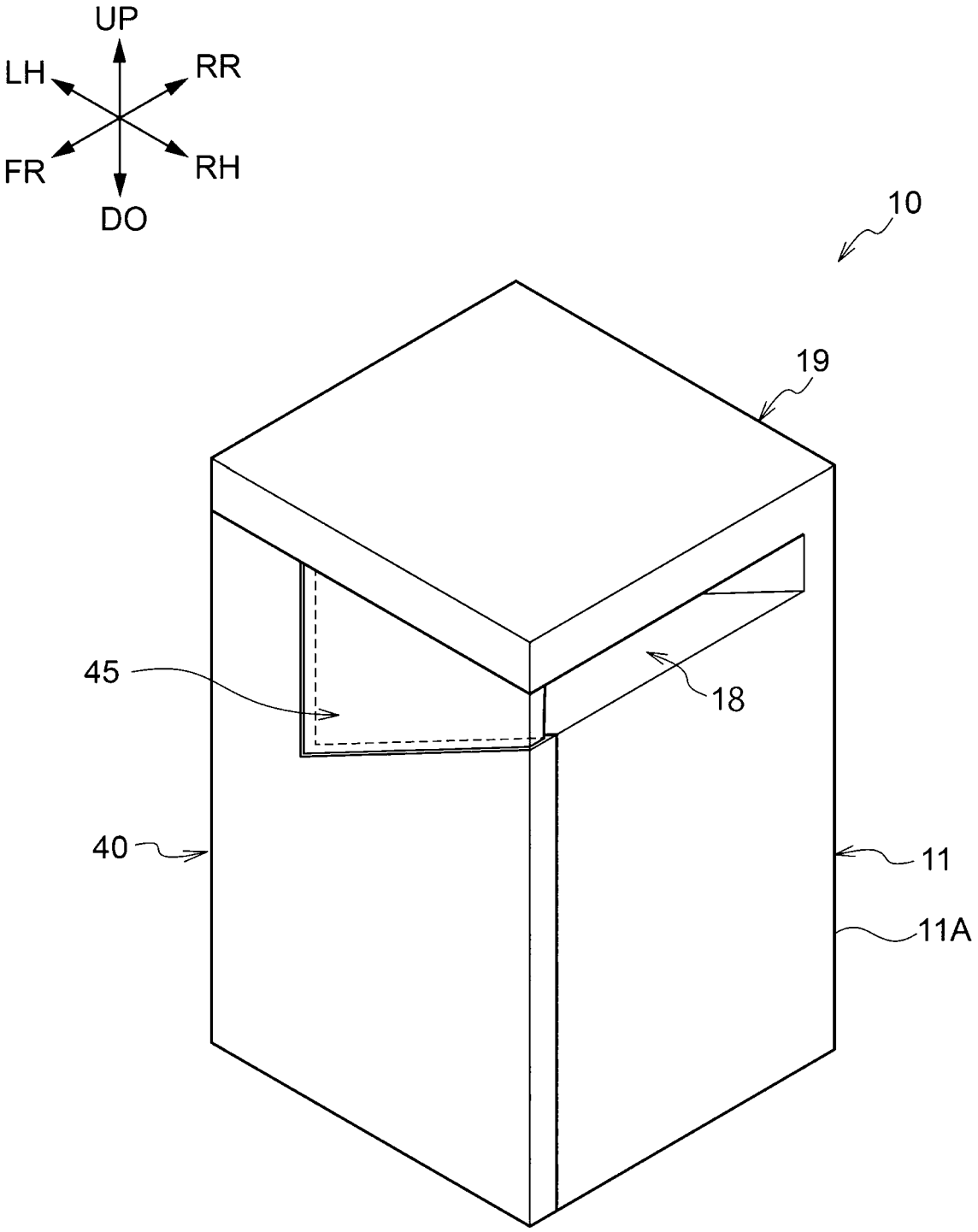
FIG. 1 is an external perspective view of an image forming apparatus according to an exemplary embodiment.
Figure 2:
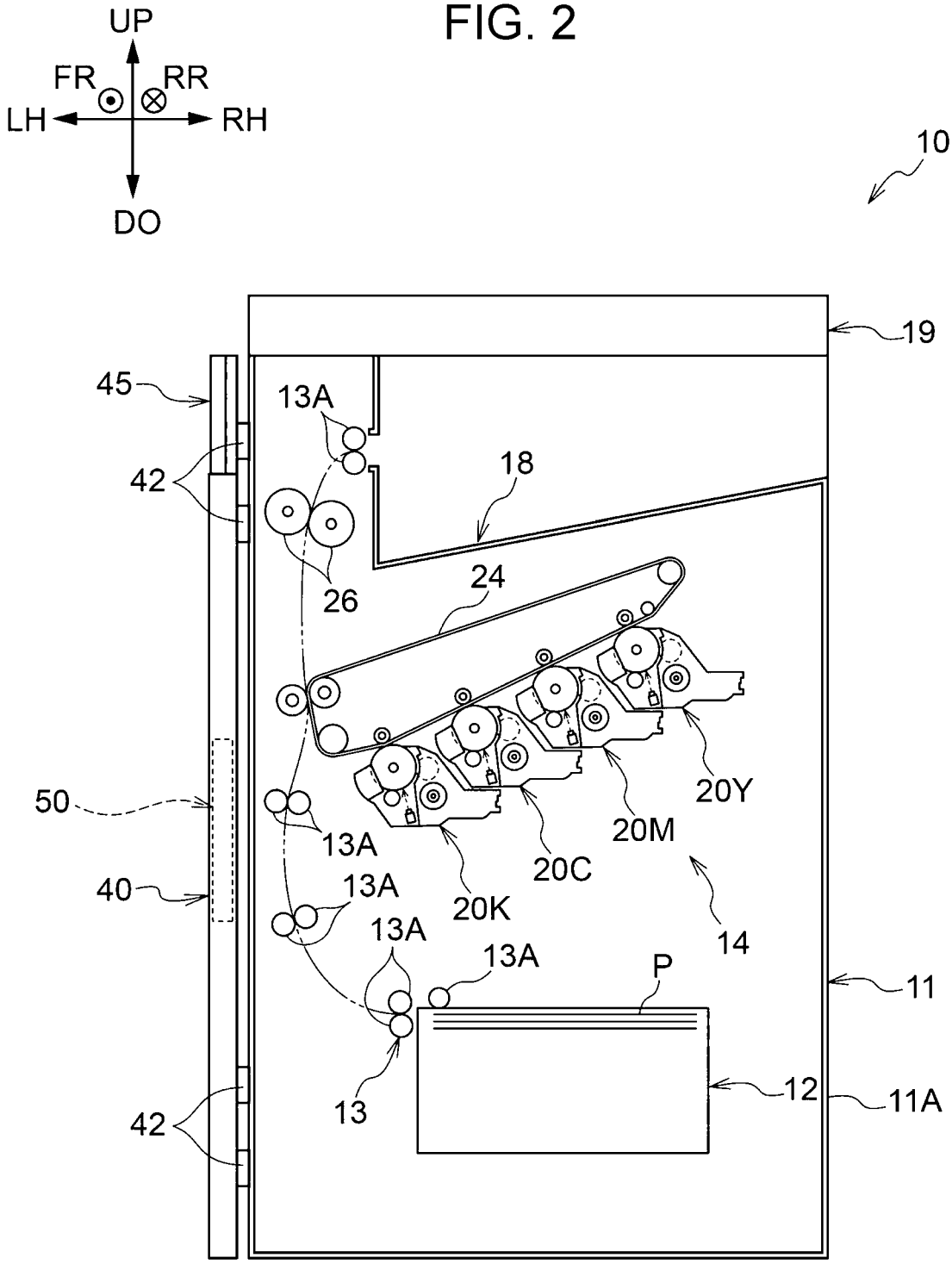
FIG. 2 is a front view of the image forming apparatus according to the present exemplary embodiment, where an openable/closeable member is in an open position.
Figure 3:
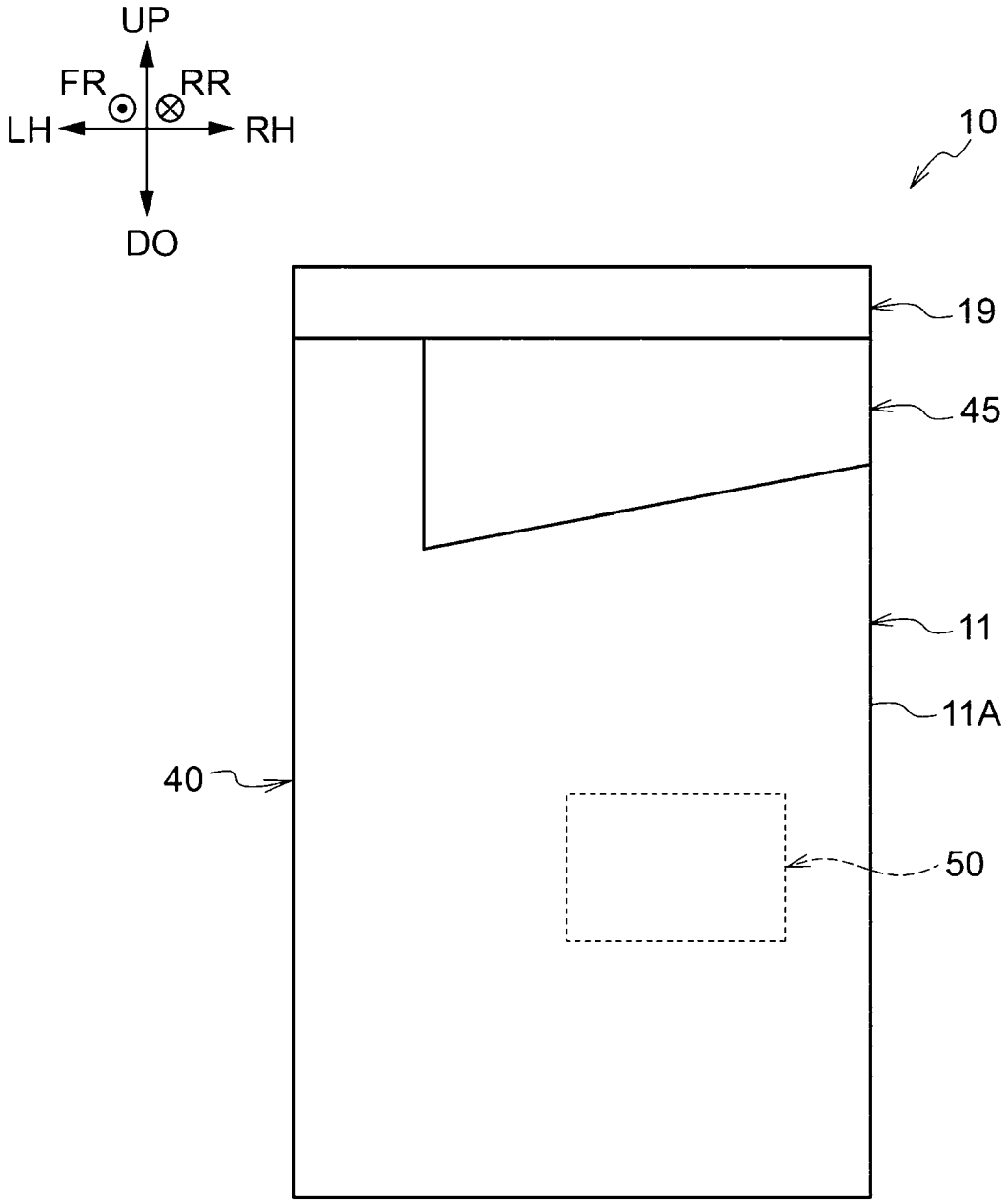
FIG. 3 is a front view of the image forming apparatus according to the present exemplary embodiment, where the openable/closeable member is in a closed position.
Figure 4:
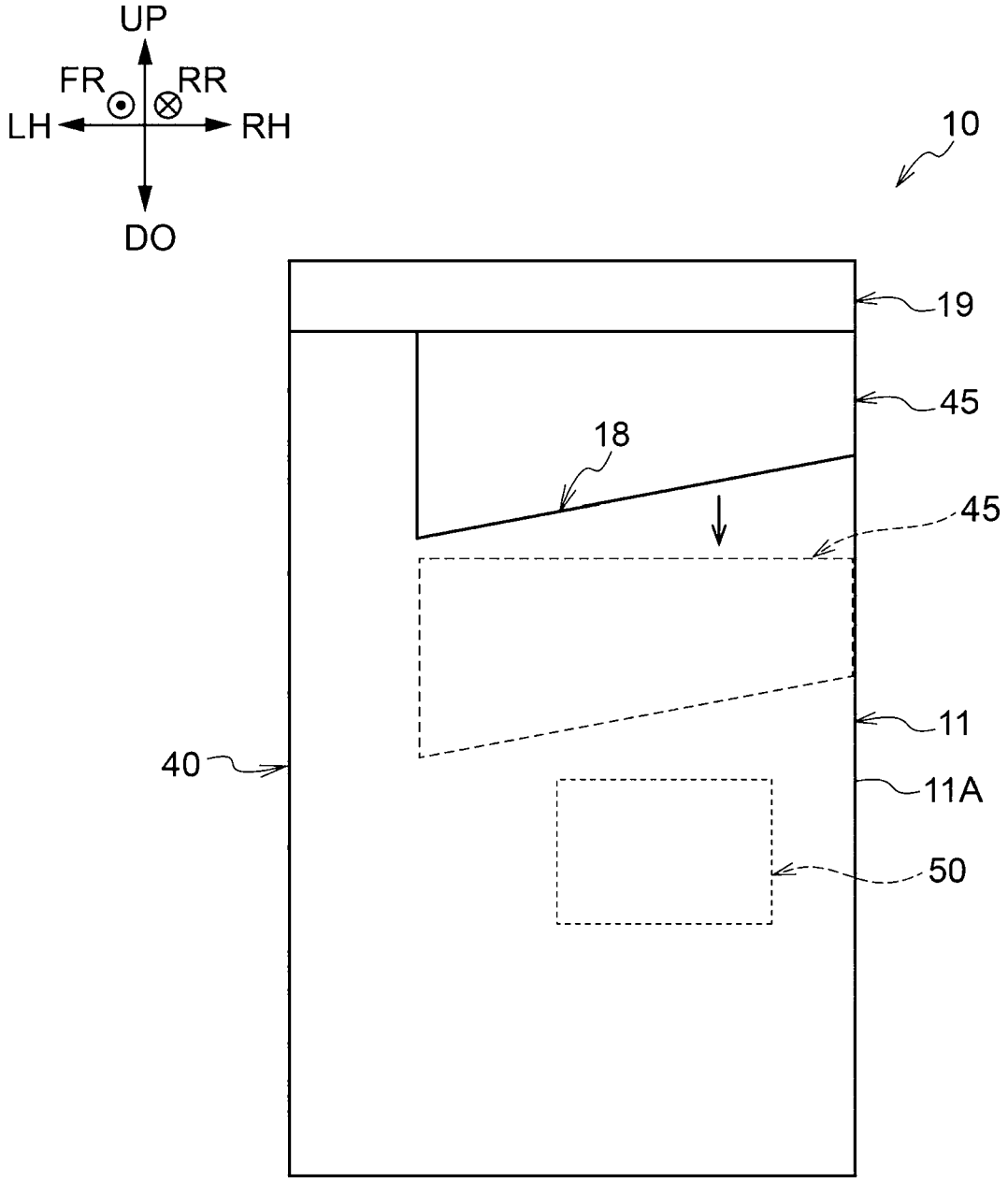
FIG. 4 is a front view of the structure illustrated in FIG. 3, where a movable portion is in an exposure position.

The structure of an image forming apparatus 10 according to an exemplary embodiment will be described. FIG. 1 is an external perspective view of the image forming apparatus 10. FIG. 2, FIG. 3, and FIG. 4 are front views of the image forming apparatus 10.

In the drawings, an arrow UP denotes the upper side of the apparatus (vertically upward), and an arrow DO denotes the lower side of the apparatus (vertically downward). In the drawings, an arrow LH denotes the left side of the apparatus, and an arrow RH denotes the right side of the apparatus. In the drawings, an arrow FR denotes the front of the apparatus, and an arrow RR denotes the rear of the apparatus. These directions are defined for convenience of illustration and do not limit the structure of the apparatus. The directions of the apparatus may be referred to without describing "of the apparatus". Specifically, for example, "the upper side of the apparatus" may be simply referred to as "the upper side".

In the following description, the "vertical direction" may be referred to as "both of the upward and downward directions" or "either one of the upward and downward directions". The "lateral direction" may be referred to as "both of the leftward and rightward directions" or "either one of the leftward and rightward directions". The "lateral direction" may be rephrased as sideward, the lateral direction, and the horizontal direction. The "front-rear direction" may also be referred to as "both of the frontward and rearward directions" or "either one of the frontward and rearward directions". The "front-rear direction" may be rephrased as sideward, the lateral direction, and the horizontal direction. The vertical direction, the lateral direction, and the front-rear direction cross each other (more specifically, they are perpendicular to each other).

In the drawings, an encircled cross sign denotes an arrow directing from the near side to the far side of the drawing. In the drawings, an encircled dot sign denotes an arrow directing from the far side to the near side of the drawing.

The image forming apparatus 10 illustrated in FIG. 1, FIG. 2, FIG. 3, and FIG. 4 is an example of an apparatus including an openable/closeable member, and is an apparatus that forms images. Specifically, as illustrated in FIG. 2, the image forming apparatus 10 includes an image forming apparatus body 11, a container portion 12, a discharging portion 18, an upper portion 19, a transporting portion 13, an image forming portion 14, an openable/closeable member 40, a movable portion 45, and a driving device 50. These components of the image forming apparatus 10 will be described below.

Image Forming Apparatus Body 11

The image forming apparatus body 11 illustrated in FIG. 1 and FIG. 2 is an example of an apparatus body, and is a portion in which the components of the image forming apparatus 10 are disposed. As illustrated in FIG. 1 and FIG. 2, the image forming apparatus body 11 specifically includes a housing 11A that accommodates each component of the image forming apparatus 10.

As illustrated in FIG. 2, in the present exemplary embodiment, the container portion 12, the transporting portion 13, and the image forming portion 14 are accommodated in the image forming apparatus body 11 (specifically, the housing 11A). The discharging portion 18 and the upper portion 19 are disposed at an upper portion of the image forming apparatus body 11 (specifically, the housing 11A). In addition, the openable/closeable member 40, the movable portion 45, and the driving device 50 are disposed at a front portion of the image forming apparatus body 11 (specifically, the housing 11A).

Container Portion 12

The container portion 12 illustrated in FIG. 2 is a portion of the image forming apparatus 10 that accommodates recording media P. The recording media P accommodated in the container portion 12 are transported to the image forming portion 14. The recording media P accommodated in the container portion 12 receive images formed thereon by the image forming portion 14. Examples of the recording media P include sheets and films. Examples of films include resin-made films and metal-made films. Instead of the above examples, various other recording media may be used as the recording media P.

Discharging Portion 18 and Upper Portion 19

The discharging portion 18 illustrated in FIG. 1, FIG. 2, and FIG. 4 is a portion to which the recording media P to which images are formed by the image forming portion 14 are discharged. The discharging portion 18 is disposed at an upper portion of the image forming apparatus body 11 (or the housing 11A). More specifically, the discharging portion 18 is disposed on the upper surface of the housing 11A.

The upper portion 19 illustrated in FIG. 1, FIG. 2, FIG. 3, and FIG. 4 is a portion forming an upper portion of the image forming apparatus 10. The upper portion 19 is disposed above the discharging portion 18, and at least partially overlaps the discharging portion 18 in a plan view. Specifically, the upper portion 19 is disposed to cover the upper portion of the discharging portion 18. The upper portion 19 is formed from, for example, a reading device that reads images of documents, and other devices and components.

Transporting Portion 13

The transporting portion 13 illustrated in FIG. 2 is a component in the image forming apparatus 10 that transports the recording media P. More specifically, the transporting portion 13 transports the recording media P accommodated in the container portion 12 to the discharging portion 18. In the present exemplary embodiment, as illustrated in FIG. 2, the transporting portion 13 includes transporting members 13A such as multiple transport rollers to transport the recording media P with the transporting members 13A.

Image Forming Portion 14

The image forming portion 14 illustrated in FIG. 2 is disposed in the image forming apparatus body 11 to form images on the recording media P. More specifically, the image forming portion 14 forms toner images (examples of images), with electrophotography, on the recording media P transported by the transporting portion 13 (specifically, the transporting members 13A). More specifically, as illustrated in FIG. 2, the image forming portion 14 includes toner-image forming portions 20Y, 20M, 20C, and 20K (hereinafter referred to as 20Y to 20K), a transfer body 24, and a fixing portion 26.

In the image forming portion 14, the toner-image forming portions 20Y to 20K each perform charging, exposure, development, and transfer operations to form toner images of yellow (Y), magenta (M), cyan (C), and black (K) on the transfer body 24. The image forming portion 14 then transfers the toner images of the respective colors formed on the transfer body 24 to one of the recording media P, and fixes the toner images to the recording medium P at the fixing portion 26. Thus, the image forming portion 14 employs an intermediate transfer method to transfer the images to the recording media P with the transfer body 24.

Openable/Closeable Member 40 and Movable Portion 45

The openable/closeable member 40 illustrated in FIG. 1, FIG. 2, FIG. 3, and FIG. 4 is a component that opens or closes the image forming apparatus body 11. More specifically, the openable/closeable member 40 is openably and closeably disposed in front of the image forming apparatus body 11 to function as a cover covering the front surface of the image forming apparatus body 11.

In the present exemplary embodiment, the openable/closeable member 40 is rotatably supported between a closed position (a position illustrated in FIG. 1, FIG. 3, and FIG. 4) and an open position (a position illustrated in FIG. 2) by support portions 42 (refer to FIG. 2) such as hinges disposed at the left end and in front of the image forming apparatus body 11. Thus, the openable/closeable member 40 is supported by the support portions 42 at only one end of the image forming apparatus body 11, and opens or closes the image forming apparatus body 11 by rotating about the support portions 42 (specifically, rotating about a vertical direction).

The movable portion 45 is movable between a covering position where it covers the discharging portion 18 (the position illustrated in FIG. 1 and FIG. 3) and an exposure position (the position illustrated in FIG. 4) where it exposes the discharging portion 18. The movable portion 45 is disposed above the openable/closeable member 40, and in front of the discharging portion 18 when the openable/closeable member 40 is in a closed position.

When the movable portion 45 is in the covering position (the position illustrated in FIG. 1 and FIG. 3), the movable portion 45 extends upward from the openable/closeable member 40 in the closed position to cover the discharging portion 18 in front of the discharging portion 18. When the movable portion 45 is in the exposure position (the position illustrated in FIG. 4), the movable portion 45 is accommodated in the openable/closeable member 40 to expose the discharging portion 18. Specifically, the exposure position (position illustrated in FIG. 4) is also referred to as a position where the movable portion 45 is drawn downward from the front of the discharging portion 18.

Driving Device 50

The driving device 50 illustrated in FIG. 2, FIG. 3, and FIG. 4 is a device that drives a target to be driven. As illustrated in FIG. 2, FIG. 3, and FIG. 4, the driving device 50 is disposed in the openable/closeable member 40. In the present exemplary embodiment, the driving device 50 produces a driving force that moves the movable portion 45 to the covering position and the exposure position.

Figure 5:
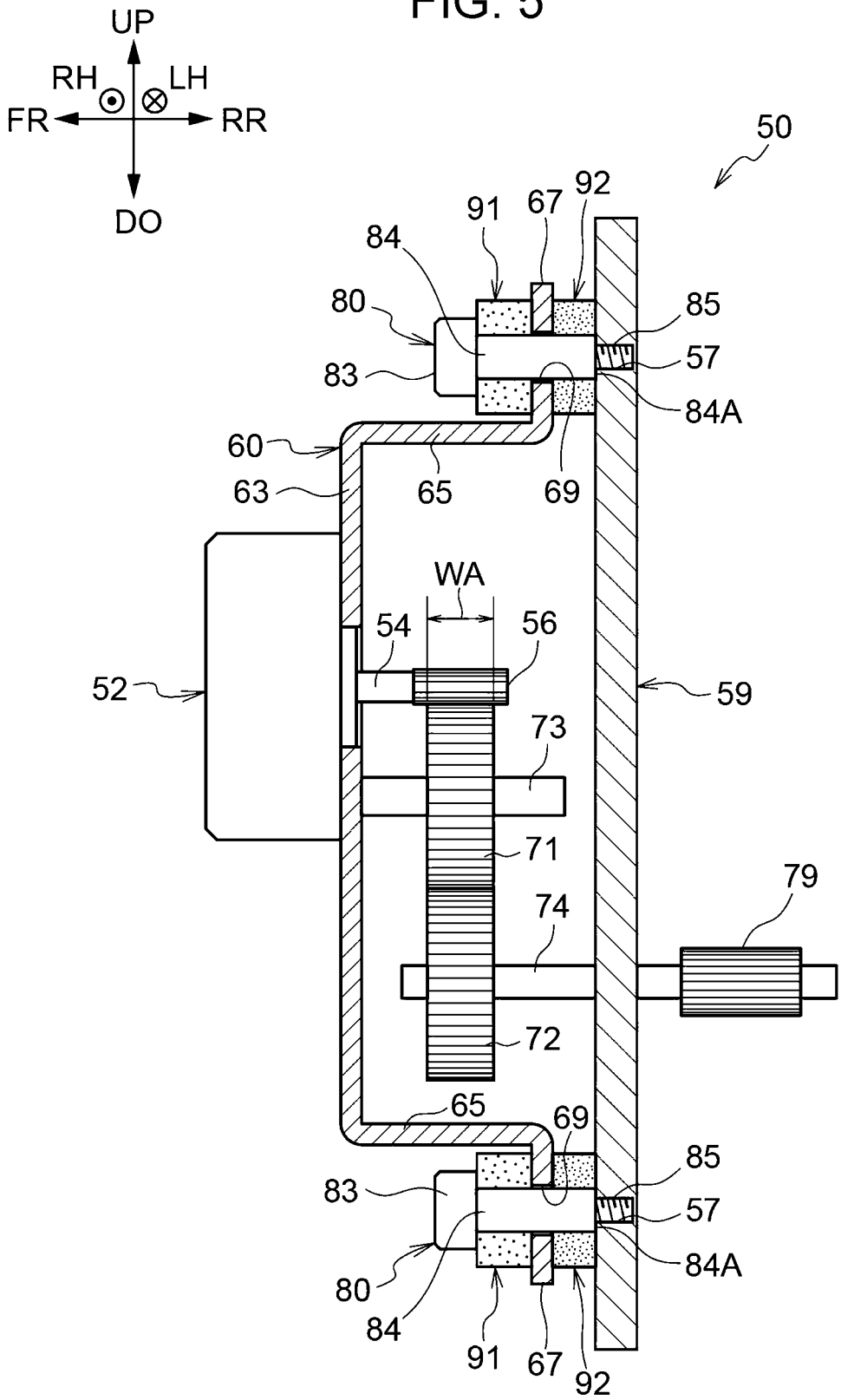
FIG. 5 is a side cross-sectional view of a driving device according to the present exemplary embodiment.
Figure 6:
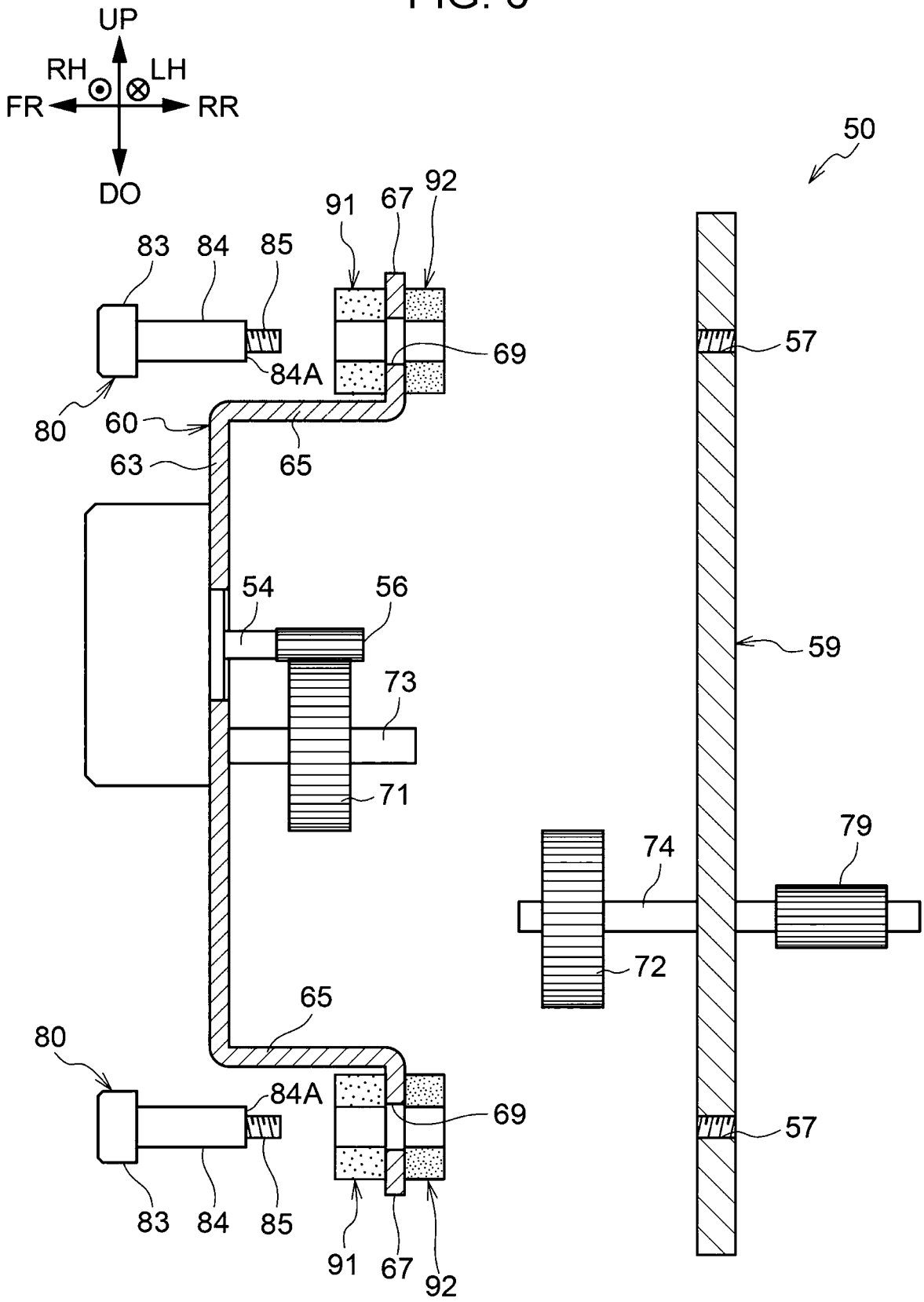
FIG. 6 is an exploded side cross-sectional view of the driving device according to the present exemplary embodiment.

More specifically, as illustrated in FIG. 5 and FIG. 6, the driving device 50 includes a driving source 52, a fixing portion 60, a first gear 71, a second gear 72, a transmission gear 79, a mount portion 59, fastening screws 80, first cushioning members 91, and second cushioning members 92.

Driving Source 52

The driving source 52 illustrated in FIG. 5 and FIG. 6 is formed from a driving motor, and outputs a rotation force serving as a driving force from a driving shaft 54. As illustrated in FIG. 5 and FIG. 6, a driving gear 56 is attached to the driving shaft 54. The driving gear 56 rotates integrally with the driving shaft 54.

Fixing Portion 60

The fixing portion 60 illustrated in FIG. 5 and FIG. 6 is a component to which the driving source 52 is fixed. The fixing portion 60 is formed from a frame made of, for example, metal. As illustrated in FIG. 5 and FIG. 6, the fixing portion 60 includes wall portions 63, 65, and 67.

The wall portion 63 vertically extends in a side cross-sectional view. The wall portions 65 form a pair, and each extend rearward from the upper end portion and the lower end portion of the wall portion 63 in a side cross-sectional view. The wall portions 67 form a pair, and each extend upward and downward from the rear end portions of the wall portions 65 in a side cross-sectional view. Each of the wall portions 67 has a through-hole 69 through which a corresponding fastening screw 80 extends.

The fixing portion 60 including the wall portions 63, 65, and 67 has a hat shape in a side cross-sectional view. The fixing portion 60 is fastened to the mount portion 59 with the fastening screws 80.

First Gear 71

The first gear 71 illustrated in FIG. 5 and FIG. 6 is an example of a first transmission portion, and transmits a driving force from the driving source 52. As illustrated in FIG. 5 and FIG. 6, the first gear 71 is attached to the fixing portion 60. More specifically, the first gear 71 is attached to the fixing portion 60 with a shaft portion 73 interposed therebetween to be rotatable with respect to the fixing portion 60. The first gear 71 is engaged with the driving gear 56. Thus, the first gear 71 rotates by receiving a rotation force of the driving source 52 through the driving gear 56.

Second Gear 72

The second gear 72 illustrated in FIG. 5 and FIG. 6 is an example of a second transmission portion, and receives a driving force of the driving source 52 from the first gear 71. As illustrated in FIG. 5 and FIG. 6, the second gear 72 is attached to the mount portion 59. More specifically, the second gear 72 is attached to the mount portion 59 with a shaft portion 74 interposed therebetween to be rotatable with respect to the mount portion 59. The second gear 72 is engaged with the first gear 71 while having an intermeshing width WA extending rearward. Thus, the second gear 72 rotates by receiving a rotation force of the driving source 52 through the first gear 71.

Transmission Gear 79

The transmission gear 79 illustrated in FIG. 5 and FIG. 6 is attached to a portion of the shaft portion 74 opposite to a portion where the second gear 72 is attached with respect to the mount portion 59 (specifically, attached to a rear portion). The transmission gear 79 functions as a transmission portion that transmits a driving force to the movable portion 45. Throughout the drawings, a transmission mechanism that transmits a driving force from the transmission gear 79 to the movable portion 45 is omitted.

Mount Portion 59

The mount portion 59 illustrated in FIG. 5 and FIG. 6 is a component to which the second gear 72 is attached. The mount portion 59 is formed from, for example, a metal-made frame (for example, a plate). As illustrated in FIG. 5 and FIG. 6, the mount portion 59 is disposed at the rear of the fixing portion 60. More specifically, the mount portion 59 is disposed at the rear of the fixing portion 60 to face the fixing portion 60 while being spaced a predetermined distance (specifically, by the thickness of the second cushioning members 92) apart from the wall portions 67 of the fixing portion 60. The mount portion 59 has screw holes 57 into which screw portions 85, described below, of the fastening screws 80 are screwed.

Fastening Screws 80

The fastening screws 80 illustrated in FIG. 5 and FIG. 6 are examples of fastening portions that fasten the fixing portion 60 and the mount portion 59 to each other. The present exemplary embodiment includes multiple fastening screws 80. As illustrated in FIG. 5 and FIG. 6, specifically, each fastening screw 80 includes a head 83, a shaft portion 84, and a screw portion 85.

The head 83 is an example of a mounted portion, and disposed on a side of the fixing portion 60 opposite to the side facing the mount portion 59 (specifically, disposed on the front side). The shaft portion 84 extends from the head 83 through the fixing portion 60 toward the mount portion 59. In other words, the head 83 is disposed at the front end of the shaft portion 84.

The shaft portion 84 extends in the front-rear direction while having an axis extending in the front-rear direction, and has, for example, a cylindrical shape. When the shaft portion 84 extends through the corresponding through-hole 69 formed in the corresponding wall portion 67 of the fixing portion 60, the shaft portion 84 extends through the fixing portion 60. The inside diameter of each through-hole 69 is greater than the outside diameter of the shaft portion 84, described below, of the corresponding fastening screw 80. Thus, the shaft portion 84 extends through the through-hole 69 while leaving a gap with respect to the wall portion 67 of the fixing portion 60.

When viewed in the front-rear direction, the head 83 has a greater diameter than the shaft portion 84, and extends radially outward with respect to the shaft portion 84.

The screw portion 85 is disposed at the rear end portion of the shaft portion 84. The screw portion 85 is narrower than the shaft portion 84. Specifically, the screw portion 85 has a smaller diameter than the shaft portion 84. In the exemplary embodiment, the screw portion 85 is coaxial with the shaft portion 84. Thus, the shaft portion 84 extends radially outward with respect to the screw portion 85. The screw portion 85 has a thread on the outer periphery, and is screwed into the corresponding screw hole 57 in the mount portion 59.

In the present exemplary embodiment, the fastening screws 80 fasten the fixing portion 60 and the mount portion 59 to each other while having the heads 83 fixed in positions at a predetermined distance apart from the mount portion 59. Specifically, when a tip end 84A of each shaft portion 84 comes into contact with the mount portion 59, the head 83 is fixed in a position at a predetermined distance apart from the mount portion 59 (specifically, the length of the shaft portion 84 in the axial direction). Specifically, in the present exemplary embodiment, the screw portions 85 are screwed into the screw holes 57 until the tip ends 84A of the shaft portions 84 come into contact with the mount portion 59 to fasten the fixing portion 60 and the mount portion 59 to each other.

First Cushioning Members 91 and Second Cushioning Members 92

Each first cushioning member 91 is disposed between the head 83 of the corresponding fastening screw 80 and the fixing portion 60. Specifically, each first cushioning member 91 is held between the head 83 of the corresponding fastening screw 80 and the corresponding wall portion 67 of the fixing portion 60 to reduce shocks and vibrations transmitted from the wall portion 67 to the head 83. In other words, each first cushioning member 91 is a mechanical energy absorber.

Each second cushioning member 92 is disposed between the fixing portion 60 and the mount portion 59. Specifically, each second cushioning member 92 is held between the corresponding wall portion 67 of the fixing portion 60 and the mount portion 59 to reduce shocks and vibrations transmitted from the wall portion 67 to the mount portion 59. In other words, each second cushioning member 92 is a mechanical energy absorber. The second cushioning members 92 have a greater spring constant than the first cushioning members 91. The spring constant indicates a constant of proportionality obtained by dividing the load exerted when a rearward compressive load is exerted on each cushioning member by a displacement of the cushioning member.

For example, elastic members formed from foams such as polyurethane foams are used as the first cushioning members 91 and the second cushioning member 92. Elastic members having a greater Young's modulus than the elastic members used for the first cushioning members 91 are used for the second cushioning members 92. In the present exemplary embodiment, when elastic members having a greater Young's modulus than the elastic members used for the first cushioning members 91 are used for the second cushioning members 92, the second cushioning members 92 have a greater spring constant than the first cushioning members 91.

Moreover, when foams are used as examples of the first cushioning members 91 and the second cushioning members 92, and foams with a greater density than the foams used for the first cushioning members 91 are used for the second cushioning members 92, the second cushioning members 92 have a greater spring constant than the first cushioning members 91.

Figure 7:
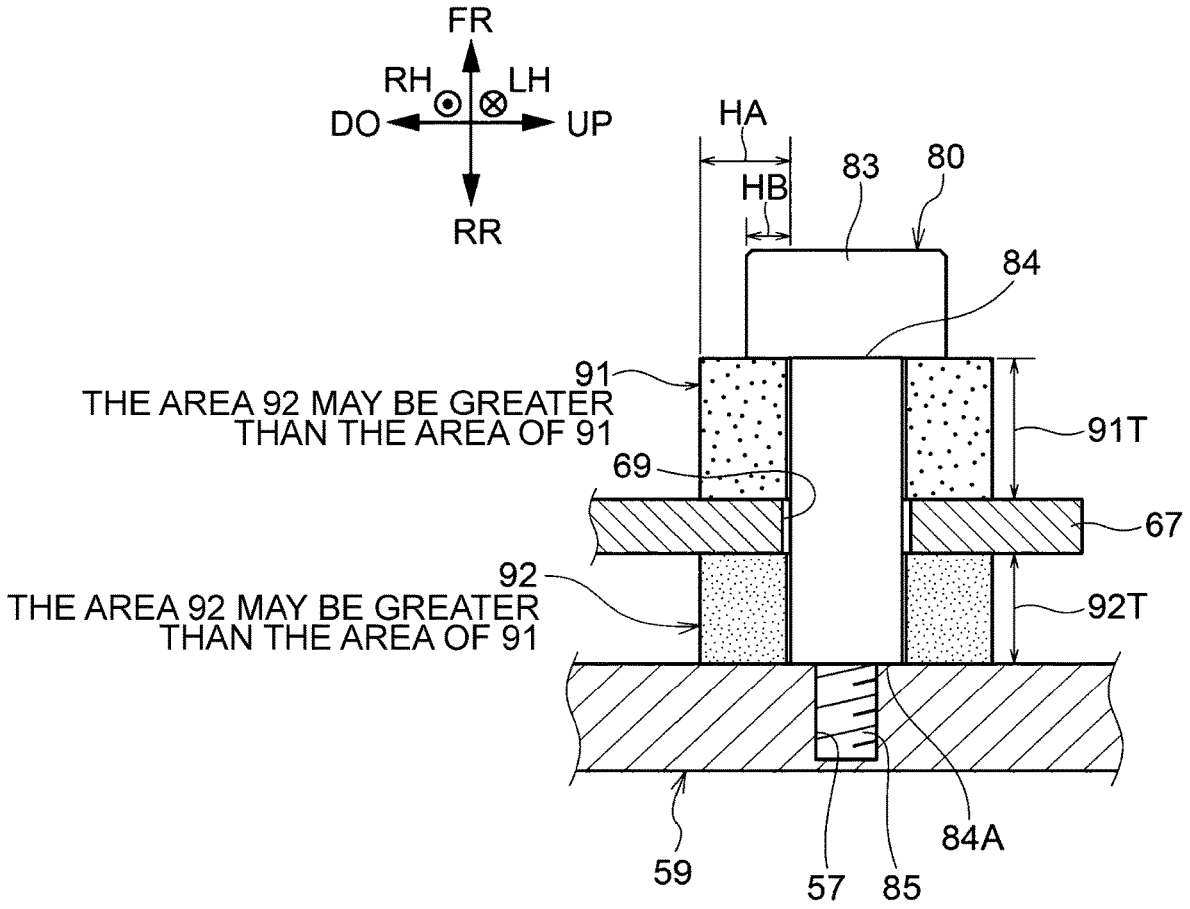
FIG. 7 is an exploded side cross-sectional view of components of the driving device according to the present exemplary embodiment including a first cushioning member, a second cushioning member, and a fastening screw.

A thickness 92T (simply referred to as "a thickness 92T" below) of each second cushioning member 92 in an unloaded state in a rearward direction is smaller than a thickness 91T (simply referred to as "a thickness 91T" below) of each first cushioning member 91 in an unloaded state in a rearward direction (refer to FIG. 7). Specifically, the thickness 92T of each second cushioning member 92 is smaller than or equal to ⅔ of the thickness 91T of each first cushioning member 91. More specifically, the thickness 92T of each second cushioning member 92 is, for example, greater than or equal to 1 mm, and smaller than or equal to 3 mm. The thickness 91T of each first cushioning member 91 is, for example, greater than or equal to 1.5 mm, and smaller than or equal to 4 mm.

Here, the unloaded state is a state where no load of compressing each cushioning member rearward is exerted on the cushioning member.

A 25% compressive load for each second cushioning member 92 is greater than or equal to twice a 25% compressive load for each first cushioning member 91. Specifically, a 25% compressive load for the second cushioning member 92 is greater than or equal to three times the 25% compressive load for each first cushioning member 91. The 25% compressive load for each second cushioning member 92 is, for example, greater than or equal to 0.20 N/mm, and smaller than or equal to 0.40 N/mm. The 25% compressive load for each first cushioning member 91 is, for example, greater than or equal to 0.05 N/mm, and smaller than or equal to 0.15 N/mm.

The 25% compressive load indicates the load used to compress each cushioning member rearward by 25% from an unloaded state.

An area HA (that is, an area HA in a rear view) of each first cushioning member 91 or each second cushioning member 92 in the directions crossing the rearward direction (that is, in the lateral direction and the vertical direction) is greater than or equal to an area HB (that is, an area HB in a front view) of the head 83 of each fastening screw 80. Specifically, the area HB is an area on the surface facing each first cushioning member 91 (rearward), and at a portion extended radially outward from the shaft portion 84.

In the present exemplary embodiment, the area of each second cushioning member 92 is the same as the area HA of each first cushioning member 91.

Operation of Present Exemplary Embodiment

In the present exemplary embodiment, each second cushioning member 92 is disposed between the fixing portion 60 and the mount portion 59, and each first cushioning member 91 is disposed between the head 83 of the corresponding fastening screw 80 and the fixing portion 60. This structure reduces vibrations produced by the driving source 52 propagated from the fixing portion 60 to the mount portion 59 through the fastening screws 80.

In the present exemplary embodiment, each second cushioning member 92 disposed between the fixing portion 60 and the mount portion 59 has a greater spring constant than each first cushioning member 91 disposed between the head 83 of the corresponding fastening screw 80 and the fixing portion 60.

Figure 8:
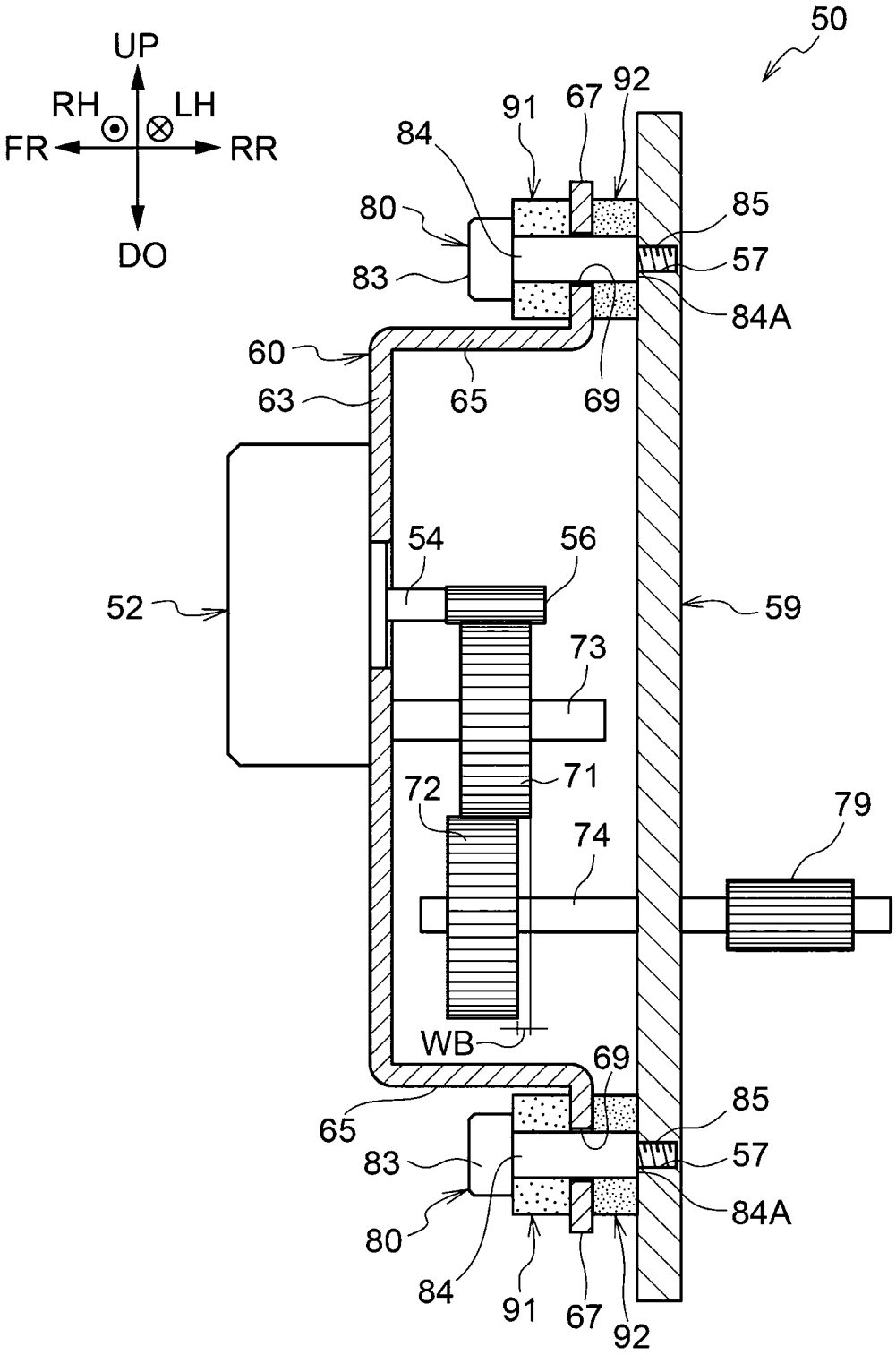
FIG. 8 is a side cross-sectional view of a driving device according to a comparative example.

When the same cushioning members are disposed between the head 83 of each fastening screw 80 and the fixing portion 60 and between the fixing portion 60 and the mount portion 59, in other words, when the same cushioning members are used for the first cushioning members 91 and the second cushioning members 92 (referred to as Structure A below), the first cushioning members 91 and the second cushioning members 92 may have unstable displacements due to, for example, the individual difference between the cushioning members. Thus, as illustrated in FIG. 8, when, for example, the second cushioning members 92 have a greater displacement than the first cushioning members 91, the relative positions of the fixing portion 60 and the mount portion 59 in the rearward direction are shifted, and the intermeshing width WA between the first gear 71 and the second gear 72 is reduced by a shift amount WB.

This may cause rotation errors due to, for example, jumping between the first gear 71 and the second gear 72, or cause vibrations or noises attributable to the rotation errors.

In contrast, in the present exemplary embodiment, as described above, the second cushioning members 92 have a greater spring constant than the first cushioning members 91. Thus, a displacement of each second cushioning member 92 falls within a predetermined range (for example, within a range of smaller than or equal to 0.2 mm) unlike in Structure A, and thus the present exemplary embodiment maintains the intermeshing width WA between the first gear 71 and the second gear 72.

Thus, unlike in Structure A, in the present exemplary embodiment, the openable/closeable member 40 supported at only one end of the image forming apparatus body 11 reduces vibrations. Thus, the present exemplary embodiment reduces vibrations propagated to the image forming portion 14 compared to Structure A, and thus reduces failures in images formed by the image forming portion 14.

In the present exemplary embodiment, each fastening screw 80 fastens the fixing portion 60 and the mount portion 59 to each other while the head 83 is fixed in a position at a predetermined distance apart from the mount portion 59.

Thus, the present exemplary embodiment maintains the intermeshing width WA between the first gear 71 and the second gear 72 compared to the case where the distance between the head 83 of each fastening screw 80 and the mount portion 59 varies when the fastening screw 80 fastens the fixing portion 60 and the head 83 to each other.

In the present exemplary embodiment, as a result of the tip end 84A of each shaft portion 84 coming into contact with the mount portion 59, the head 83 is fixed in a position at a predetermined distance apart from the mount portion 59 (specifically, a length of the shaft portion 84 in the axial direction).

Thus, the fastening operation of screwing the screw portions 85 into the screw holes 57 in the mount portion 59 allows the tip ends 84A of the shaft portions 84 to come into contact with the mount portion 59, and allows the heads 83 to be fixed in positions at a predetermined distance (specifically, a length of the shaft portion 84 in the axial direction) apart from the mount portion 59. This operation has fewer processes than when the fastening operation and the positioning operation are separately performed.

In the present exemplary embodiment, the thickness 92T of each second cushioning member 92 is smaller than the thickness 91T of each first cushioning member 91.

This structure maintains the intermeshing width WA between the first gear 71 and the second gear 72 compared to the case where the thickness 92T of each second cushioning member 92 is greater than or equal to the thickness 91T of each first cushioning member 91.

Specifically, in the present exemplary embodiment, the thickness 92T of each second cushioning member 92 is smaller than or equal to ⅔ of the thickness 91T of each first cushioning member 91.

This structure maintains the intermeshing width WA between the first gear 71 and the second gear 72 compared to the case where the thickness 92T of each second cushioning member 92 exceeds 2/3 of the thickness 91T of each first cushioning member 91.

More specifically, in the present exemplary embodiment, the thickness 92T of each second cushioning member 92 is, for example, greater than or equal to 1 mm, and smaller than or equal to 3 mm.

This structure maintains the intermeshing width WA between the first gear 71 and the second gear 72 compared to the case where the thickness 92T of each second cushioning member 92 exceeds 3 mm.

In the present exemplary embodiment, the 25% compressive load for each second cushioning member 92 is greater than or equal to twice the 25% compressive load for each first cushioning member 91.

This structure maintains the intermeshing width WA between the first gear 71 and the second gear 72 compared to the case where the 25% compressive load for each second cushioning member 92 is smaller than twice the 25% compressive load for each first cushioning member 91.

Specifically, in the present exemplary embodiment, the 25% compressive load for each second cushioning member 92 is greater than or equal to three times the 25% compressive load for each first cushioning member 91.

This structure maintains the intermeshing width WA between the first gear 71 and the second gear 72 compared to the case where the 25% compressive load for each second cushioning member 92 is smaller than three times the 25% compressive load for each first cushioning member 91.

In the present exemplary embodiment, the area HA of each first cushioning member 91 or each second cushioning member 92 in the directions crossing the rearward direction (that is, the lateral direction and the vertical direction) is greater than or equal to the area HB of the head 83 of each fastening screw 80.

This structure reduces vibrations produced by the driving source 52 propagated from the fixing portion 60 to the mount portion 59, compared to the case where the area HA of each first cushioning member 91 or each second cushioning member 92 is smaller than the area HB of the head 83 of each fastening screw 80.

Modification Examples of First Cushioning Members 91 and Second Cushioning Members 92

In the present exemplary embodiment, the area of each second cushioning member 92 is the same as the area HA of each first cushioning member 91, but this is not the only possible example. For example, the area of each second cushioning member 92 may be greater than the area HA of each first cushioning member 91.

In this structure, a displacement of each second cushioning member 92 falls within a predetermined range unlike in the case where the area of each second cushioning member 92 is smaller than or equal to the area HA of each first cushioning member 91. This structure maintains the intermeshing width WA between the first gear 71 and the second gear 72.

In the present exemplary embodiment, elastic members with a greater Young's modulus than elastic members used for the first cushioning members 91 are used for the second cushioning members 92, and thus the second cushioning members 92 have a greater spring constant than the first cushioning members 91. However, this is not the only possible example. For example, the second cushioning members 92 may have a greater spring constant than the first cushioning members 91 by using elastic members with the same Young's modulus and with different thicknesses, shapes, and other characteristics for the first cushioning members 91 and the second cushioning members 92.

In the present exemplary embodiment, the thickness 92T of the second cushioning members 92 is smaller than the thickness 91T of the first cushioning members 91. However, the thickness 92T of the second cushioning members 92 may be greater than or equal to the thickness 91T of the first cushioning members 91.

In the present exemplary embodiment, the thickness 92T of the second cushioning members 92 is greater than or equal to 1 mm and smaller than or equal to 3 mm by way of example, but this is not the only possible example. For example, the thickness 92T of the second cushioning members 92 may exceed 3 mm.

In the present exemplary embodiment, the 25% compressive load for each second cushioning member 92 is greater than or equal to twice the 25% compressive load for each first cushioning member 91, but this is not the only possible example. For example, the 25% compressive load for each second cushioning member 92 may be smaller than twice the 25% compressive load for each first cushioning member 91.

In the present exemplary embodiment, the area HA of each first cushioning member 91 or each second cushioning member 92 is greater than or equal to the area HB of the head 83 of the corresponding fastening screw 80, but this is not the only possible example. The area HA of each first cushioning member 91 or each second cushioning member 92 may be smaller than the area HB of the head 83 of the corresponding fastening screw 80.

Modification Examples of Image Forming Apparatus 10

An example of an apparatus including a cover is not limited to the above image forming apparatus 10. The apparatus including a cover may be, for example, a transporting device that transports a target object, an image reading device that reads an image of a medium, a preprocessing device that performs various processing on a recording medium on which no image has been formed, and a postprocessing device that performs various processing (such as bookbinding, binding, and folding) on a recording medium on which an image has been formed.

Modification Examples of Image Forming Portion 14

The example of the image forming portion is not limited to the above image forming portion 14. The image forming portion may be, for example, an image forming portion employing a direct transfer method with which the toner-image forming portions 20Y to 20K directly transfer toner images to the recording media P without using the transfer body 24. Alternatively, the image forming portion may be, for example, any image forming portion that forms images on the recording media P, for example, an image forming portion that forms images by ejecting ink to the recording media P.

Other Modifications

In the present exemplary embodiment, the fastening screws 80 fasten the fixing portion 60 and the mount portion 59 to each other while the heads 83 are fixed in positions at a predetermined distance apart from the mount portion 59, but this is not the only possible example. For example, the fastening screws 80 may fasten the fixing portion 60 and the mount portion 59 to each other without the heads 83 being fixed in position with respect to the mount portion 59.

In the present exemplary embodiment, as a result of the tip ends 84A of the shaft portions 84 coming into contact with the mount portion 59, the heads 83 are fixed in positions at a predetermined distance (specifically, a length of the shaft portions 84 in the axial direction) apart from the mount portion 59, but this is not the only possible example. For example, the heads 83 may be fixed in positions at a predetermined distance apart from the mount portion 59 by bringing portions of the fastening screws 80 other than the tip ends 84A of the shaft portions 84 into contact with the mount portion 59.

The present disclosure is not limited to the above exemplary embodiments, and may be modified, changed, or improved in various manners within the scope not departing from the gist thereof. For example, two or more of the modification examples described above may be combined as appropriate.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

Appendix (((1)))

A driving device, comprising:

a driving source;

a fixing portion to which the driving source is fixed;

a first transmission portion attached to the fixing portion to transmit a driving force from the driving source;

a second transmission portion engaged with the first transmission portion while having an intermeshing width in a first direction to receive the driving force from the first transmission portion;

a mount portion located in the first direction from the fixing portion and to which the second transmission portion is attached;

a fastening portion including a mounted portion disposed on a side of the fixing portion opposite to a side facing the mount portion, the fastening portion fastening the fixing portion and the mount portion to each other;

a first cushioning member disposed between the mounted portion and the fixing portion; and a second cushioning member disposed between the fixing portion and the mount portion, and having a greater spring constant than the first cushioning member.

(((2)))

The driving device according to (((1))), wherein the fastening portion fastens the fixing portion and the mount portion to each other while the mounted portion is fixed in a position at a predetermined distance apart from the mount portion.

(((3)))

The driving device according to (((2))), wherein the fastening portion includes:

a head serving as the mounted portion;

a shaft portion extending from the head through the fixing portion toward the mount portion; and a screw portion narrower than the shaft portion, and wherein the head is fixed in a position at a predetermined distance apart from the mount portion as a result of a tip end of the shaft portion coming into contact with the mount portion.

(((4)))

The driving device according to any one of (((1))) to (((3))), wherein a thickness of the second cushioning member in an unloaded state in the first direction is smaller than a thickness of the first cushioning member in an unloaded state in the first direction.

(((5)))

The driving device according to (((4))), wherein the thickness of the second cushioning member in the unloaded state in the first direction is smaller than or equal to ⅔ of the thickness of the first cushioning member in the unloaded state in the first direction.

(((6)))

The driving device according to any one of (((1))) to (((5))), wherein a thickness of the second cushioning member in an unloaded state in the first direction is greater than or equal to 1 mm and smaller than or equal to 3 mm.

(((7)))

The driving device according to any one of (((1))) to (((6))), wherein a 25% compressive load for the second cushioning member is greater than or equal to twice a 25% compressive load for the first cushioning member.

(((8)))

The driving device according to (((7))), wherein the 25% compressive load for the second cushioning member is greater than or equal to three times the 25% compressive load for the first cushioning member.

(((9)))

The driving device according to any one of (((1))) to (((8))), wherein an area of each of the first cushioning member and the second cushioning member in crossing directions crossing the first direction is greater than or equal to an area of the mounted portion in the crossing directions.

(((10)))

The driving device according to (((9))), wherein the area of the second cushioning member is greater than the area of the first cushioning member.

(((11)))

An apparatus including an openable/closeable member, comprising:

an apparatus body;

an openable/closeable member that opens or closes the apparatus body; and the driving device according to any one of (((1))) to (((10))) disposed at the openable/closeable member.

(((12)))

An image forming apparatus serving as the apparatus including an openable/closeable member according to (((11))), comprising:

an image forming portion that is disposed at the apparatus body to form images on recording media;

a discharging portion to which recording media on which images are formed by the image forming portion are discharged; and a movable portion that is movable between a position where the movable portion covers the discharging portion and a position where the movable portion exposes the discharging portion, wherein the driving device produces a driving force to move the movable portion.

What is claimed is:

1. A driving device, comprising:

a driving source;

a fixing portion to which the driving source is fixed;

a first transmission portion attached to the fixing portion to transmit a driving force from the driving source;

a second transmission portion engaged with the first transmission portion while having an intermeshing width in a first direction to receive the driving force from the first transmission portion;

a mount portion located in the first direction from the fixing portion and to which the second transmission portion is attached;

a fastening portion including a mounted portion disposed on a side of the fixing portion opposite to a side facing the mount portion, the fastening portion fastening the fixing portion and the mount portion to each other;

a first cushioning member disposed between the mounted portion and the fixing portion; and a second cushioning member disposed between the fixing portion and the mount portion, and having a greater spring constant than the first cushioning member.

2. The driving device according to claim 1, wherein the fastening portion fastens the fixing portion and the mount portion to each other while the mounted portion is fixed in a position at a predetermined distance apart from the mount portion.

3. The driving device according to claim 2, wherein the fastening portion includes:

a head serving as the mounted portion;

a shaft portion extending from the head through the fixing portion toward the mount portion; and a screw portion narrower than the shaft portion, and wherein the head is fixed in a position at a predetermined distance apart from the mount portion as a result of a tip end of the shaft portion coming into contact with the mount portion.

4. An apparatus including an openable/closeable member, comprising:

an apparatus body;

an openable/closeable member that opens or closes the apparatus body; and the driving device according to claim 3 disposed at the openable/closeable member.

5. An apparatus including an openable/closeable member, comprising:

an apparatus body;

an openable/closeable member that opens or closes the apparatus body; and the driving device according to claim 2 disposed at the openable/closeable member.

6. The driving device according to claim 1, wherein a thickness of the second cushioning member in an unloaded state in the first direction is smaller than a thickness of the first cushioning member in an unloaded state in the first direction.

7. The driving device according to claim 6, wherein the thickness of the second cushioning member in the unloaded state in the first direction is smaller than or equal to ⅔ of the thickness of the first cushioning member in the unloaded state in the first direction.

8. An apparatus including an openable/closeable member, comprising:

an apparatus body;

an openable/closeable member that opens or closes the apparatus body; and the driving device according to claim 7 disposed at the openable/closeable member.

9. An apparatus including an openable/closeable member, comprising:

an apparatus body;

an openable/closeable member that opens or closes the apparatus body; and the driving device according to claim 6 disposed at the openable/closeable member.

10. The driving device according to claim 1, wherein a thickness of the second cushioning member in an unloaded state in the first direction is greater than or equal to 1 mm and smaller than or equal to 3 mm.

11. An apparatus including an openable/closeable member, comprising:

an apparatus body;

an openable/closeable member that opens or closes the apparatus body; and the driving device according to claim 10 disposed at the openable/closeable member.

12. The driving device according to claim 1, wherein a 25% compressive load for the second cushioning member is greater than or equal to twice a 25% compressive load for the first cushioning member.

13. The driving device according to claim 12, wherein the 25% compressive load for the second cushioning member is greater than or equal to three times the 25% compressive load for the first cushioning member.

14. An apparatus including an openable/closeable member, comprising:

an apparatus body;

an openable/closeable member that opens or closes the apparatus body; and the driving device according to claim 13 disposed at the openable/closeable member.

15. An apparatus including an openable/closeable member, comprising:

an apparatus body;

an openable/closeable member that opens or closes the apparatus body; and the driving device according to claim 12 disposed at the openable/closeable member.

16. The driving device according to claim 1, wherein an area of each of the first cushioning member and the second cushioning member in crossing directions crossing the first direction is greater than or equal to an area of the mounted portion in the crossing directions.

17. The driving device according to claim 16, wherein the area of the second cushioning member is greater than the area of the first cushioning member.

18. An apparatus including an openable/closeable member, comprising:

an apparatus body;

an openable/closeable member that opens or closes the apparatus body; and the driving device according to claim 16 disposed at the openable/closeable member.

19. An apparatus including an openable/closeable member, comprising:

an apparatus body;

an openable/closeable member that opens or closes the apparatus body; and the driving device according to claim 1 disposed at the openable/closeable member.

20. An image forming apparatus serving as the apparatus including an openable/closeable member according to claim 19, comprising:

an image forming portion that is disposed at the apparatus body to form images on recording media;

a discharging portion to which recording media on which images are formed by the image forming portion are discharged; and a movable portion that is movable between a position where the movable portion covers the discharging portion and a position where the movable portion exposes the discharging portion, wherein the driving device produces a driving force to move the movable portion.

* * * * *